US009697776B2

(12) United States Patent
Jun et al.

(10) Patent No.: US 9,697,776 B2
(45) Date of Patent: Jul. 4, 2017

(54) ORGANIC LIGHT EMITTING DISPLAY DEVICE AND DRIVING METHOD THEREOF

(71) Applicant: SAMSUNG DISPLAY CO., LTD., Yongin-si, Gyeonggi-Do (KR)

(72) Inventors: Bongju Jun, Yongin-si (KR); Daeun Kang, Yongin-si (KR); Jongsik Park, Yongin-si (KR)

(73) Assignee: Samsung Display Co., Ltd., Yongin-Si, Gyeonggi-do (KR)

( * ) Notice: Subject to any disclaimer, the term of this patent is extended or adjusted under 35 U.S.C. 154(b) by 84 days.

(21) Appl. No.: 14/876,978

(22) Filed: Oct. 7, 2015

(65) Prior Publication Data

US 2016/0210897 A1 Jul. 21, 2016

(30) Foreign Application Priority Data

Jan. 20, 2015 (KR) ..... 10-2015-0009463

(51) Int. Cl.
*G09G 3/3291* (2016.01)
*G09G 3/3233* (2016.01)

(52) U.S. Cl.
CPC ..... *G09G 3/3291* (2013.01); *G09G 3/3233* (2013.01); *G09G 2320/045* (2013.01); *G09G 2320/048* (2013.01); *G09G 2320/0626* (2013.01); *G09G 2360/16* (2013.01)

(58) Field of Classification Search
CPC ..... G09G 3/3291; G09G 3/3233
USPC ..... 345/690
See application file for complete search history.

(56) References Cited

U.S. PATENT DOCUMENTS 6,556,258 B1 * 4/2003 Yoshida ..... G02B 6/0055 349/57
7,732,809 B2 * 6/2010 Adachi ..... H01L 27/12 257/40
8,835,947 B2 * 9/2014 Ichinose ..... H01L 51/5265 257/89
2007/0148492 A1 * 6/2007 Tsuboyama ..... H01L 27/3211 428/690
2008/0165308 A1 * 7/2008 Shiraishi ..... G02B 6/0038 349/65

(Continued)

FOREIGN PATENT DOCUMENTS

KR 10-2008-0060890 A 7/2008
KR 10-2012-0094736 A 8/2012

(Continued)

*Primary Examiner* — Fred Tzeng
(74) *Attorney, Agent, or Firm* — Lee & Morse, P.C.

(57) ABSTRACT

An organic light emitting display device includes a storage area, a degradation compensator, and a display driver. The storage area stores accumulated data for a plurality of pixels. The degradation compensator determines degrees of degradation of the pixels based on the accumulated data, selects a flat up mode or a flat down mode, selects a reference pixel based on the selected mode, generates ratios of a maximum emission brightness of the reference pixel to a maximum emission brightness of the pixels as first coefficients, and generates modulated data for the pixels using the first coefficients and margin ratios. The panel driver transforms the modulated data to data voltages for the pixels, adds the modulated data to the accumulated data, and stores the accumulated data in the storage area.

20 Claims, 8 Drawing Sheets

(56) References Cited

U.S. PATENT DOCUMENTS

| | | | | |
|---|---|---|---|---|
| 2008/0192786 | A1* | 8/2008 | Bakkers | H01L 33/0004 372/44.01 |
| 2010/0072880 | A1* | 3/2010 | Adachi | H01L 27/12 313/498 |
| 2012/0176476 | A1* | 7/2012 | Schmidt | G01S 17/89 348/46 |
| 2012/0212516 | A1 | 8/2012 | Ahn et al. | |
| 2014/0168039 | A1 | 6/2014 | Kim et al. | |
| 2015/0242701 | A1* | 8/2015 | Tokui | H04N 5/243 382/190 |

FOREIGN PATENT DOCUMENTS

| | | | |
|---|---|---|---|
| KR | 10-2014-0058149 | A | 5/2014 |
| KR | 10-2014-0078500 | A | 6/2014 |
| KR | 10-2014-0095276 | A | 8/2014 |

* cited by examiner

ORGANIC LIGHT EMITTING DISPLAY DEVICE AND DRIVING METHOD THEREOF

CROSS-REFERENCE TO RELATED APPLICATION

Korean Patent Application No. 10-2015-0009463, filed on Jan. 20, 2015, and entitled, "Organic Light Emitting Display Device and Driving Method Thereof," is incorporated by reference herein in its entirety.

BACKGROUND

1. Field

One or more embodiments described herein relate to an organic light emitting display device and a method for driving an organic light emitting display device.

2. Description of the Related Art

Various types of flat panel displays have been developed. Examples include liquid crystal displays, field emission displays, plasma display panels, and organic light emitting devices. Of these, organic light emitting displays have fast response speed, low power consumption, excellent brightness and color purity, and are thin and light weight, and thus are suitable for use in various type of devices.

An organic light emitting display generates images using organic light emitting diodes (OLEDs). Each OLED emits light from a corresponding pixel based on the recombination of electrons and holes in an emission layer. The brightness of the light is controlled based on current from a pixel circuit. The pixel circuit controls the current based on an applied data voltage.

However, the pixels of an organic light emitting display may not be able to display images of a desired brightness due to degradation of their OLEDs. This degradation may take place over time and may cause the brightness of emitted light to vary among pixels even when a same data signal is applied.

SUMMARY

In accordance with one embodiment, an organic light emitting display device includes a display panel includes a plurality of pixels including an organic light emitting devices to emit light based on data currents corresponding to data voltages; a storage area to store accumulated data of the pixels; a degradation compensator to determine degrees of degradation of the pixels based on the accumulated data, select a flat up mode or a flat down mode, select a reference pixel based on the selected mode, generate ratios of a maximum emission brightness of the reference pixel to a maximum emission brightness of the pixels as first coefficients, and generate modulated data for the pixels using the first coefficients and margin ratios; and a panel driver to transform the modulated data to the data voltages, add the modulated data to the accumulated data, and store the accumulated data in the storage area.

The degradation compensator may include a reference pixel determiner to select a least degraded pixel or a most degraded pixel as the reference pixel based on the selected mode; a coefficient calculator to calculate ratios of the maximum emission brightness of the reference pixel to the maximum emission brightness of the pixels as first coefficients; and a data modulator to generate the modulated data for the pixels in correspondence to the first coefficients.

When the selected mode is the flat up mode, the reference pixel determiner may determine the least degraded pixel as the reference pixel, and the data modulator may generate first modulated data for the pixels to increase brightness of the pixels in correspondence to the first coefficient. When the operation mode is the flat down mode, the reference pixel determiner may determine the most degraded pixel as the reference pixel, and the data modulator may generate second modulated data for the pixels to decrease brightness of the pixels in correspondence to the first coefficient.

The degradation compensator may include an operation mode determiner to change the selected mode from the flat up mode to the flat down mode when a greatest first coefficient of the pixels is equal to or greater than a pre-set critical value.

When the selected mode is the flat down mode, the coefficient calculator may calculate second coefficients for uniformly increasing brightness of the pixels, and the data modulator may generate third modulated data for the pixels based on the first coefficients, the second coefficients, and the second modulated data. The second coefficients may decrease over time. The brightness of the pixels may increase when the selected mode is the flat up mode. The brightness of the pixels may decrease when the selected mode is the flat down mode.

In accordance with one or more other embodiments, a method for driving an organic light emitting display device includes accumulating data input to a plurality of pixels and storing the accumulated data; determining degrees of degradation of the pixels based on the accumulated data; selected a flat up mode or a flat down mode based on the degrees of degradation of the pixels; selecting a reference pixel based on the selected mode; generating ratios of a maximum emission brightness of the reference pixel to a maximum emission brightness of the pixels as first coefficients and generating modulated data to be supplied to the pixels based on the first coefficients and margin ratios; and supplying the modulated data to the pixels.

The method may include adding the modulated data to the accumulated data of the corresponding pixels and storing the accumulated data. Generating the modulated data may include calculating ratios of the maximum emission brightness of the reference pixel to the maximum emission brightness of the respective pixels as the first coefficients of the pixels, and generating the modulated data for the pixels in correspondence to the first coefficients.

Selecting the reference pixel may include selecting a least degraded pixel or a most degraded pixel as the reference pixel based on the selected mode. Selecting the reference pixel may include selecting the reference pixel as the least decreased pixel when the selected mode is the flat up mode, and generating the modulated data may include generating first modulated data to increase brightness of the pixels in correspondence to the first coefficient.

Selecting the reference pixel may include selecting the most degraded pixel as the reference pixel when the selected mode is the flat down mode, and generating the modulated data may include generating second modulated data for the pixels to decrease brightness of the pixels in correspondence to the first coefficient.

The method may include generating third modulated data for the pixels based on the first coefficients, the second coefficients, and the second modulated data. The second coefficients may decrease over time. The method may include changing from the flat up mode to the flat down mode when a greatest first coefficient for the pixels is equal to or greater than a pre-set critical value.

In accordance with one or more other embodiments, an apparatus includes a degradation compensator to determine degrees of degradation of a plurality of pixels based on data accumulated for the pixels, select a flat up mode or a flat down mode, select a reference pixel based on the selected mode, generate ratios of a predetermined emission brightness of the reference pixel to a predetermined emission brightness of the pixels as first coefficients, and generate modulated data for the pixels using the first coefficients and margin ratios; and a panel driver to transform the modulated data to the data voltages, add the modulated data to the accumulated data, and store the accumulated data in a storage area. The predetermined emission brightness may be a maximum emission brightness.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
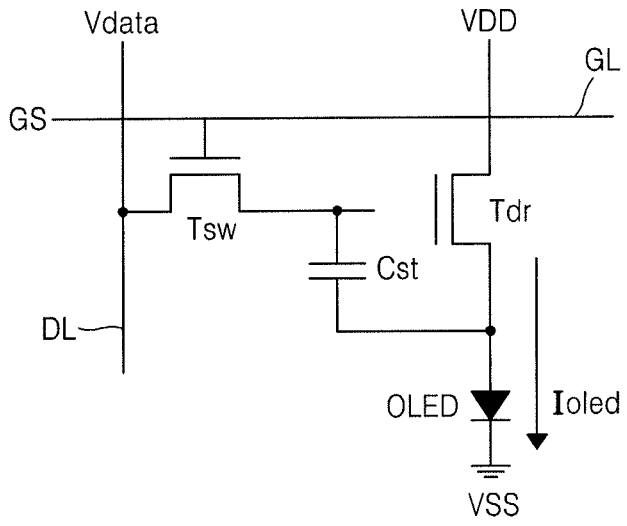
FIG. 1 illustrates an embodiment of a pixel circuit.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments may be combined to form additional embodiments. Like reference numerals refer to like elements throughout.

FIG. 1 illustrates an embodiment of a pixel circuit of an organic light emitting display device. Referring to FIG. 1, the pixel includes a pixel circuit and an organic light emitting diode OLED.

The pixel circuit includes a driving transistor T1 and a switching transistor T2. The switching transistor T2 includes a first electrode for receiving a data signal from a data line DL and a second electrode that is connected to a first electrode of the driving transistor T1. The driving transistor T1 receives the data signal from the switching transistor T2 and outputs a driving current IEL corresponding to the received data signal to the organic light emitting diode OLED. Furthermore, the first electrode of the driving transistor T1 receives a driving voltage ELVDD, and a second electrode of the driving transistor T1 is connected to an anode electrode of the organic light emitting diode OLED. A gate electrode of the switching transistor T2 may be connected to a scan line SL that supplies a scan signal for transmitting the data signal to the driving transistor T1.

The pixel circuit includes a storage capacitor Cst having a first electrode to receive the driving voltage ELVDD and a second electrode connected to a gate electrode of the driving transistor T1.

The organic light emitting diode OLED emits light at a brightness corresponding to the driving current IEL transmitted from the driving transistor T1. The organic light emitting diode OLED has a cathode electrode connected to a line that supplies a second driving voltage ELVSS. The second driving voltage ELVSS may be a reference voltage, and the reference voltage may be a ground voltage.

If the organic light emitting diode OLED is degraded, the organic light emitting diode OLED may not be able to emit light at a desired brightness, even if a driving voltage of a same magnitude as a driving voltage applied before degradation is applied by the driving transistor T1. This may also be the case for pixel circuits have other structures, e.g., ones including a different number of transistors and/or capacitors.

Figure 2:
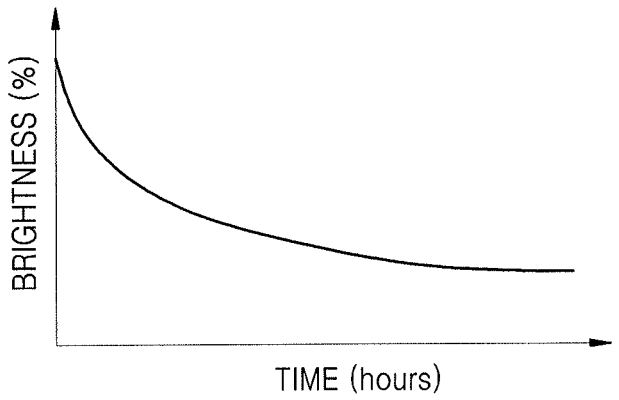
FIG. 2 illustrates an example of a change in brightness that may occur in an organic light emitting diode over time.

FIG. 2 is a graph illustrating an example of a change in brightness that may take place in one type of organic light emitting diode (OLED) over time. Referring to FIG. 2, degradation of the OLED may accelerate as a driving time increases. Thus, a brightness characteristic gradually decreases, e.g., brightness degradation and brightness deviation may occur due to degradation of the OLED.

For example, if an OLED that emits light at a brightness of 300 nit when a current of I1 flows is degraded, the OLED emits light at a brightness lower than 300 nit when a current of I1 flows. The phenomenon may also occur when a data voltage of a particular magnitude is applied to a pixel including an OLED. Therefore, even if voltages or currents of a same magnitude are applied to a pixel including a less-degraded OLED and a pixel including a more-degraded OLED, the brightness of light emitted by the pixels may be different from each other.

In accordance with one embodiment, to achieve uniform brightness in a display panel with a plurality of pixels having different degrees of degradation, a current or a voltage greater than an originally required current or voltage may be applied to pixels having a relatively higher degree of degradation.

Figure 3:
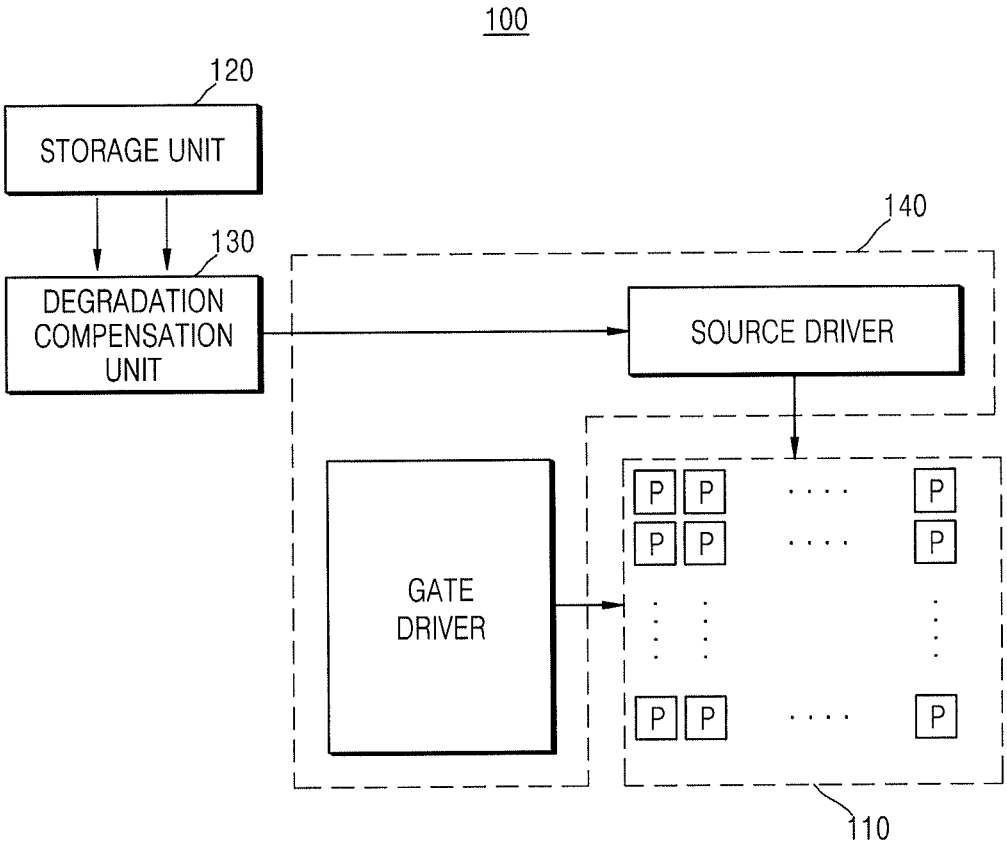
FIG. 3 illustrates an embodiment of an organic light emitting display.

FIG. 3 illustrates an embodiment of an organic light emitting display device 100 which includes a display panel 110, a storage unit 120, a degradation compensation unit 130, and a panel driving unit 140. The display panel 110 includes a plurality of pixels, each of which includes an organic light emitting device that emits light based on a data current generated according to a data voltage.

Each pixel may display one color from among a red color, a green color, and a blue color. In one embodiment, a pixel displaying a red color, a pixel displaying a green color, and a pixel displaying a blue color may be sequentially and alternately arranged. The emitted colors of light may combine to be recognized as a single color of light. In another embodiment, the pixels may include a red pixel, a green pixel, a blue pixel, and a white pixel that are adjacent to one another.

In one example, each pixel includes an organic light emitting device. When data signals of highest grayscale values are respectively applied to the red, green, and blue pixels and the organic light emitting devices emit lights, red light, green light, and blue light are emitted and mix with one another to form white light. When data signals of high grayscale values are respectively applied to the red and green pixels and a low grayscale value is applied to the blue pixel, the red and green light may mix with the blue light to form yellow-based light.

The pixels may be arranged at intersections of scan lines arranged in rows and data lines arranged columns of the display panel 110. Each pixel receives a scan signal and a data signal from corresponding ones of the scan lines and the data lines.

The storage unit 120 accumulates and stores data for input to respective pixels. The data may be grayscale data corresponding to magnitudes of data voltages to be applied to the pixels. For example, an 8-bit driving panel may display grayscale values from 0 to 255. The grayscale value of 0 may correspond to the color black and accumulated data thereof corresponds to 0. The grayscale value of 255 may correspond to the color white and accumulated data thereof corresponds to 255.

Therefore, data accumulated at a pixel, to which data corresponding to grayscale value of 0 is continuously input for a designated time period, has a value less than that of data accumulated at a pixel to which data corresponding to grayscale 255 is continuously input for the time period.

The storage unit 120 may accumulate and store data respectively input to the pixels and may continue to accumulate and store data as long as the organic light emitting display device is being driven.

The accumulated data may be used as an index for determining degradation of an organic light emitting device in a corresponding pixel. For example, an organic light emitting device in a pixel having a large value of accumulated data may be considered to have on average emitted light of higher brightness. Thus, this organic light emitting device may therefore be more degraded than an organic light emitting device having a smaller value of accumulated data.

The degradation compensation unit 130 determines the degrees of degradation of the pixels based on accumulated data of the pixels and selects one of a plurality of operation modes based on the degrees of degradation. The degree of degradation of a pixel as determined by the degradation compensation unit 130 may refer to the degree of degradation of an organic light emitting device in a corresponding pixel and may be determined, for example, based on a relative degree of degradation.

The operation modes may include a flat up mode and a flat down mode. The flat up mode is a mode for performing upward compensation of the brightness of pixels, other than a least degraded pixel. The flat up mode may therefore refer to compensation for increasing the brightness of pixels other than the reference pixel. The flat down mode is a mode for performing downward compensation of the brightness of pixels, other than a most degraded pixel. The flat down mode may therefore refer to compensation for increasing the brightness of pixels other than a reference pixel. As a result, the overall display panel may become brighter in the flat up mode, whereas the overall display panel may become darker in the flat down mode.

The degradation compensation unit 130 selects a reference pixel with respect to the operation mode, generates a ratio between the maximum emission brightness of the reference pixel and the maximum emission brightness of the pixels as first coefficients, and generates modulated data using the first coefficients and margin ratios. In another embodiment, the degradation compensation unit 130 may generate the ratio between a predetermined emission brightness of the reference pixel and a predetermined brightness of the pixels where the predetermined emission brightness is value different from maximum emission brightness.

The reference pixel is determined based on the operation mode. In one embodiment, the least degraded pixel or the most degraded pixel may be determined as the reference pixel. Since compensation is performed to increase brightness of pixels in the flat up mode, the brightest pixel (e.g., the least degraded pixel) may be determined as a reference pixel. Since compensation is performed to decrease brightness of pixels in the flat down mode, the darkest pixel (e.g., the most degraded pixel) may be determined as a reference pixel.

The first coefficients may correspond to ratios of degrees of degradation of pixels other than a reference pixel to the reference pixel. A pixel determined as a reference pixel in the flat up mode may be the least degraded pixel. The first coefficient is a ratio of the maximum emission brightness of the reference pixel to the maximum emission brightness of an arbitrary pixel from among pixels that are more degraded than the reference pixel.

For example, in the flat up mode, if the maximum emission brightness of a reference pixel is 260 nit and the maximum emission brightness of a first pixel from among the plurality of pixels is 250 nit, the first coefficient of the first pixel is 1.04.

The degradation compensation unit 130 generates modulated data to be supplied to the pixels using the first coefficients calculated as described above and margin ratios. Since a reference pixel is a reference regarding other pixels for degradation-compensation, data supplied by a system may be supplied to the reference pixel without modification. The system may be, for example, any kind of graphics driver which supplies graphic data to pixels. Pixels to which the modulated data is supplied may be pixels other than the reference pixel.

In one example, the first coefficient of the first pixel is 1.04. This value indicates that the first pixel is degraded by 1.04 times the degree of degradation of the reference pixel. The degradation compensation unit 130 may generate modulated data to be supplied to a corresponding pixel based on the first coefficient. For example, since the first coefficient of the first pixel is 1.04, a data voltage that is 1.04 times greater than data supplied by the system may be supplied to the first pixel. The degradation compensation unit 130 may generate modulated data corresponding to the data voltage to be supplied to the first pixel.

In another embodiment, the degradation compensation unit 130 may generate modulated data based on data voltages to be supplied to respective pixels using a look-up table. The look-up table may store relationships between first coefficients and modulated data.

Because there is a limit to increasing the brightness of respective pixels in the flat up mode, margin rates may be determined to be values related to the limit. For example, if it is assumed that the actual maximum emission brightness of respective pixels in a display panel including organic light emitting devices is 100%, 90% brightness may be set as the maximum emission brightness in the system. In a display panel configured as described above, pixels may actually emit brighter light, but the respective pixels may be set to normally emit light up to 90% of the actual maximum brightness.

As a result, degraded pixels may be compensated to emit brighter light in the flat up mode. However, degradation compensation may be performed within a designated margin ratio. For example, if the plurality of pixels are configured to have margin ratio of 10%, brightness of corresponding pixels may not be sufficiently compensated with respect to first coefficients exceeding 1.1. Therefore, if the first coefficient of an arbitrary pixel exceeds 1.1, the first coefficient of the pixel may be determined as 1.1 and modulated data corresponding to the first coefficient of 1.1 may be generated.

Referring to FIG. 3, the panel driving unit 140 includes a data driver and a gate driver. The pixels in the display panel 110 may be respectively arranged at intersections between gate lines in rows and a data lines arranged in columns of the display panel 110. Each pixel receives a gate signal and a data signal from the gate lines and the data lines.

Based on a data control signal, the data driver supplies data signals corresponding to input data to the pixels via data lines. Furthermore, the gate driver receives a gate control signal and generates gate signals. The gate driver supplies the gate signals to the pixels via the gate lines, and pixels may be selected by row based on the gate signal and the data signals.

The panel driving unit 140 may transform the modulated data into the data voltage, add the modulated data to accumulated data of corresponding pixels, and store the accumulated data in the storage unit 120. These operations may be performed, for example, by a data driver.

Data voltages input into the pixels may be generated from input data supplied, for example, from an external system or a graphic card. The panel driving unit 140 may generate data voltages corresponding to the input data for input into respective ones of the pixels.

For a degraded pixel to emit a light of a particular brightness, a larger data voltage may be applied to the pixel than a data voltage applied to the pixel before degradation has occurred. In this latter case, the data voltage may correspond to input data. For a degraded pixel to emit a light of a desired brightness, data corresponding to brightness higher than the desired brightness may be input. Therefore, the modulated data may correspond to input data of a brightness higher than the desired brightness.

When modulated data is generated by the degradation compensation unit 130 and is input to the panel driving unit 140, the panel driving unit 140 generates data voltages and supplies the data voltages to respective pixels. Next, the panel driving unit 140 accumulates the modulated data as accumulated data of corresponding pixels and stores the accumulated data in the storage unit 120, so that degrees of degradation of pixels may be determined based on the actual data supplied to the corresponding pixels.

Figure 4:
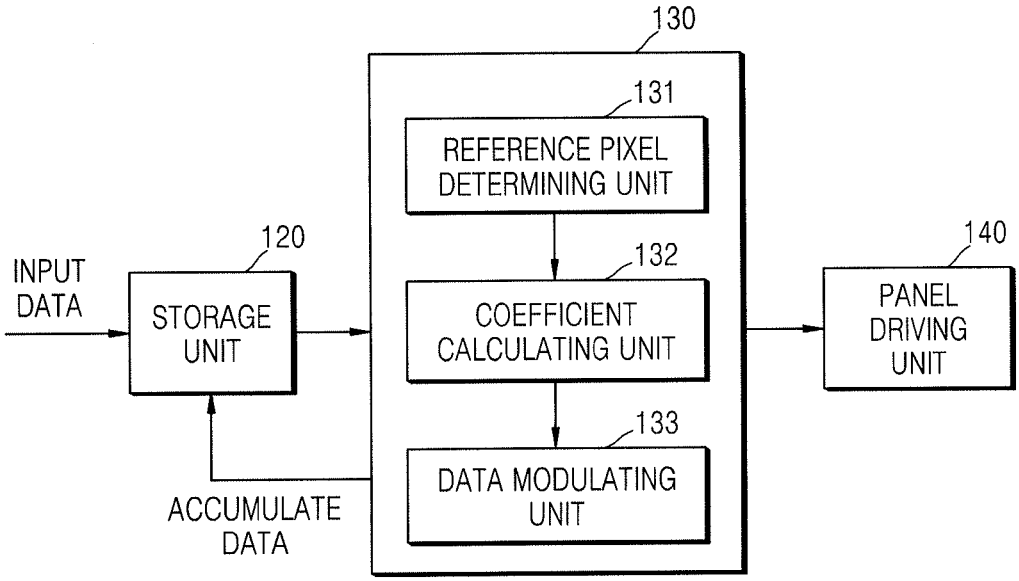
FIG. 4 illustrates an embodiment of an internal configuration of the organic light emitting display device.

FIG. 4 illustrates an embodiment of an internal configuration of the organic light emitting display device in FIG. 3. The storage unit 120 receives input data from an external system or a graphics card and stores data accumulated at pixels corresponding to the received input data. Next, the storage unit 120 receives modulated data generated by the degradation compensation unit 130, adds the received modulated data to accumulated data of corresponding pixels, and store the accumulated data.

The panel driving unit 140 receives input data or modulated data from the degradation compensation unit 130, generates data voltages corresponding to the received input data or modulated data, and supplies the data voltage to a display panel.

The degradation compensation unit 130 includes a reference pixel determining unit 131, a coefficient calculating unit 132, and a data modulating unit 133. The reference pixel determining unit 131 selects the least degraded pixel or the most degraded pixel from among the pixels as a reference pixel based on the operation mode. The reference pixel determining unit 131 selects the least degraded pixel when the operation mode is the flat up mode and selects the most degraded pixel when the operation mode is the flat down mode.

The coefficient calculating unit 132 calculates ratios of degrees of degradation of the pixels against a degree of degradation of the reference pixel as first coefficients of the pixels. Since a pixel selected as a reference pixel in the flat up mode is the least degraded pixel, values of the first coefficients are 1 or greater. Since a pixel selected as a reference pixel in the flat down mode is the most degraded pixel, values of the first coefficients are less than or equal to 1. If the value of the first coefficient is equal to 1, the first coefficient is calculated with respect to a pixel with a degree of degradation may be identical to that of the reference pixel.

The data modulating unit 133 generates modulated data to be supplied to the respective pixels in correspondence to the first coefficients. The first coefficients are calculated based on an operation mode and degrees of degradation of the reference pixel and the respective pixels. The data modulating unit 133 may generate the modulated data based on the first coefficients and margin ratios.

The data modulating unit 133 may generate first modulated data to be supplied to the respective pixels to increase brightness of the respective pixels in proportion to the first coefficients when the operation mode is the flat up mode, and may generate second modulated data to be supplied to the respective pixels to decrease brightness of the respective pixels in proportion to the first coefficients when the operation mode is the flat down mode.

Figure 5:
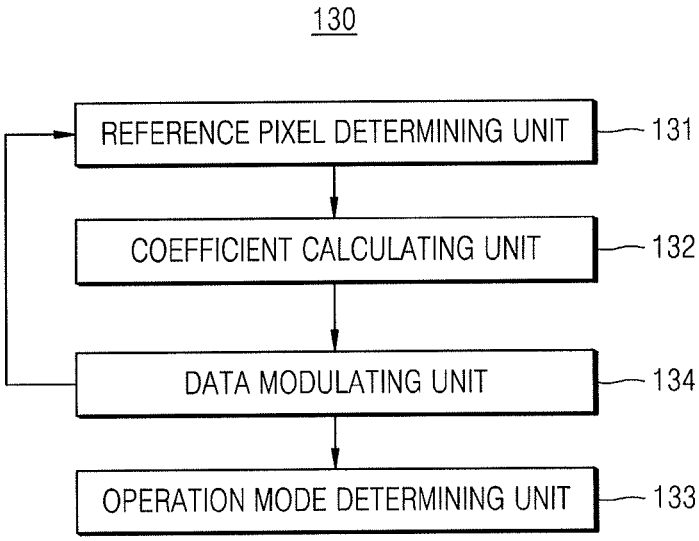
FIG. 5 illustrates according to an embodiment; a degradation compensation unit.

FIG. 5 illustrates another embodiment of the degradation compensation unit 130 which includes an operation mode determining unit 134 for changing the operation mode. If the greatest first coefficient from among the first coefficients is equal to or greater than a pre-set critical value, the operation mode determining unit 134 changes the operation mode from the flat up mode to the flat down mode.

Each pixel in the display panel includes an organic light emitting device having a designated margin regarding emission brightness. Therefore, upward compensation may be performed in the flat up mode. However, if a degree of degradation of a degraded pixel relative to a reference pixel is equal to or exceeds a particular critical value, upward compensation of brightness in the flat up mode may not be possible. The critical value at which compensation of brightness is impossible may be determined, for example, based on a predetermined brightness margin ratio.

For example, if a margin ratio of 10% is applied to a pixel capable emitting light at the maximum brightness of 300 nit, the pixel emits a light at the maximum brightness of about 270 nit in a general operation mode. When the pixel is degraded and becomes unable to emit a light at a brightness of 270 nit even if a voltage or a current corresponding to the maximum brightness prior to the degradation of the corresponding pixel is applied thereto, the degradation compensation unit 130 may enable the corresponding pixel to emit a light at a brightness of about 270 nit by using a margin of the corresponding pixel in the flat up mode.

However, if the pixel is degraded and is only able to emit a light at the maximum brightness of about 240 nit, the maximum emission brightness of the pixel becomes about 264 nit even if the maximum emission brightness of the pixel is upwardly compensated by using the 10% margin of the corresponding pixel. In other words, emission brightness of a pixel may not be upwardly compensated to the maximum emission brightness of a reference pixel in the flat up mode after the corresponding pixel is degraded beyond a certain degree.

In this case, the operation mode may be changed to the flat down mode, the most degraded pixel may be selected as a reference pixel and the other pixels may be downwardly compensated based on brightness of the newly selected reference pixel. Therefore, the brightness of the pixels may be uniform. First coefficients and margin ratios may be considered for changing an operation mode from the flat up mode to the flat down mode, where it is evident that the critical value may vary according to the margin ratios.

Figure 6:
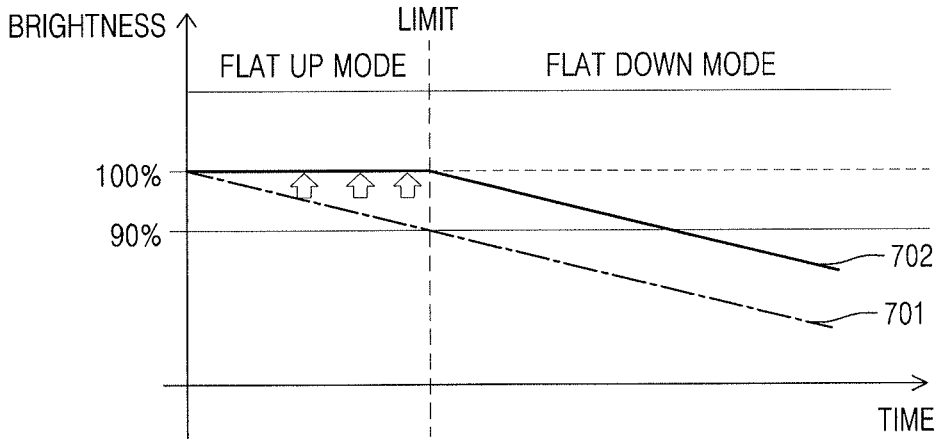
FIG. 6 illustrates an example of a change in brightness of the organic light emitting display device over time.

FIG. 6 is a graph illustrating a change in brightness in an organic light emitting display device over time. In FIG. 6, a first curve 701 shows a change in brightness over time for one type of method proposed for attempting to make the brightness of all pixels in a display panel uniform as the brightness of the pixels degrades over time. As shown by the first curve 701, even if the brightness of all pixels is uniform, brightness degradation over time is not enhanced.

The second curve 702 shows a change in brightness over time in one embodiment of the organic light emitting display device 100. The organic light emitting display device 100 may be driven in the flat up mode and the flat down mode. Since a pixel with the least degree of degradation and the highest maximum emission brightness is selected as a reference pixel, and since the brightness of other pixels are upwardly compensated in the flat up mode, the initial brightness of the organic light emitting display device 100 may be maintained for longer period of time.

A pixel selected as a reference pixel in the flat up mode may be the least degraded pixel in the display panel, where the reference pixel may be degraded and is unable to emit a light at the initial brightness. In this case, modulated data may be generated, such that the maximum emission brightness of all pixels in the display panel including the reference pixel becomes the maximum emission brightness set at the initial operation of the organic light emitting display device 100.

Meanwhile, if the difference between the maximum emission brightness of a degree of degradation of a reference pixel and the maximum emission brightness of the most degraded pixel exceeds a pre-set critical value in the flat up mode (e.g., the limit point in FIG. 6), the most degraded pixel may be unable to emit light at the same brightness as the reference pixel. Therefore, from this point, the operation mode is changed to the flat down mode, the most degraded pixel is selected as a reference pixel, and the brightness of the other pixels are compensated according to the brightness of the newly selected reference pixel.

Figure 7A:
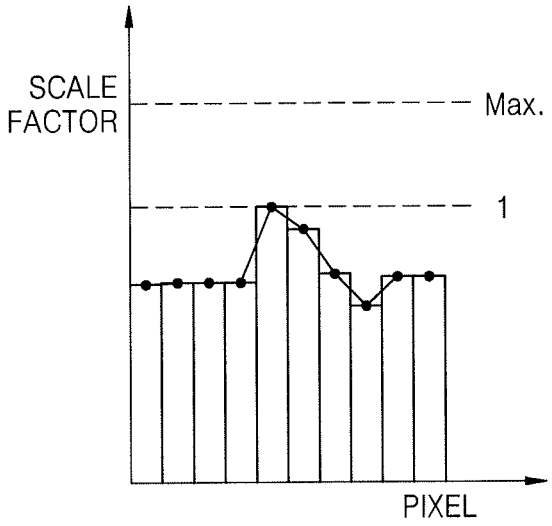
FIGS. 7A and 7B illustrate examples of brightness compensation in a flat down mode.
Figure 7B:
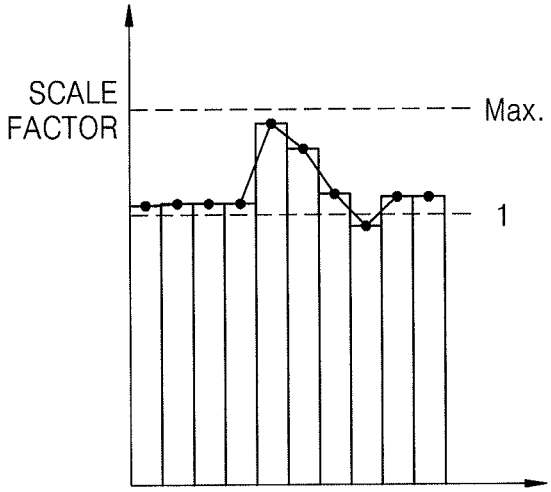

FIGS. 7(*a*) and 7(*b*) illustrate examples of brightness compensation in the flat down mode. As described above with reference to FIG. 4, the data modulating unit 133 may generate second modulated data to decrease the brightness of the pixels in proportion to the first coefficients in the flat down mode.

When the operation mode is changed from the flat up mode to the flat down mode, the most degraded pixel is selected as a reference pixel and the brightness of the pixels other than the reference pixel is downwardly compensated according to the brightness of the reference pixel. Therefore, the overall brightness of a display panel may be significantly decreased. As a result, the user of the display panel may perceive an inconsistency or other adverse effect. Therefore, significant decrease of brightness may be prevented by changing the operation mode from the flat up mode to the flat down mode.

Referring back to FIG. 4, if the operation mode is the flat down mode, the coefficient calculating unit 132 calculates second coefficient for uniformly increasing brightness of the pixels, and the data modulating unit 133 may generate third modulated data to be supplied to the pixels based on the first coefficient, the second coefficient, and the second modulated data.

FIG. 7(*a*) is a graph showing degrees of degradation of other pixels against a degree of degradation of a reference pixel when the operation mode is changed from the flat up mode to the flat down mode. Referring to FIG. 7(*a*), the horizontal axis indicates locations of respective pixels and the vertical axis indicates scale factors. In one embodiment, the 'scale factors' may correspond to the first coefficient described above with respect to FIGS. 2 to 5. For example, the scale factors may correspond to a ratio of the maximum emission brightness of a reference pixel against the maximum emission brightness of pixels other than the reference pixel. Therefore, in FIG. 7(*a*), a pixel corresponding to a scale factor 1 may be the reference pixel.

FIG. 7(*b*) shows examples where the vertical axis indicates sums of first coefficients and second coefficients. Even when the degree of degradation of the most degraded pixel is too high for brightness compensation in the flat up mode, since pixels have certain margin ratios, the brightness of all pixels including a reference pixel may be increased to a certain degree based on the margin ratios, even after the operation mode is changed to the flat down mode. In this case, the second coefficients may be values less than or equal to a value obtained by multiplying the maximum emission brightness of a reference pixel in the flat down mode by a margin ratio.

Since the maximum emission brightness of a reference pixel gradually decreases due to degradation of an organic light emitting display device as driving time increases, the second coefficients may decrease over time.

Figure 8:
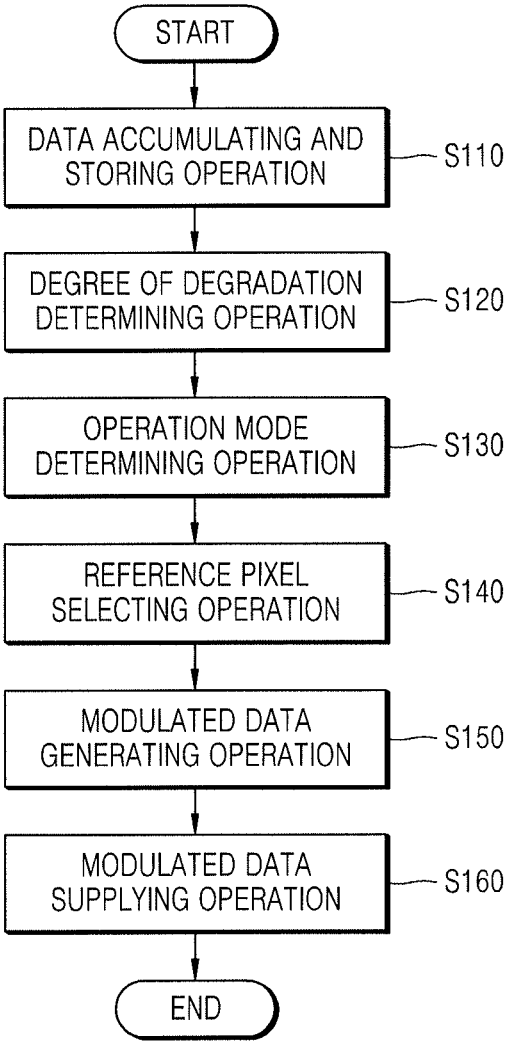
FIG. 8 illustrates an embodiment of a method for driving an organic light emitting display device.

FIG. 8 an embodiment of a method for driving an organic light emitting display device. The organic light emitting display device includes a display panel having a plurality of pixels with organic light emitting devices that emit light based on data currents generated according to data voltages. The display device may be, for example, any of the embodiments of the display device described herein.

The method includes a data accumulating and storing operation S110, a degree of degradation determining operation S120, an operation mode determining operation S130, a reference pixel selecting operation S140, a modulated data generating operation S150, and a modulated data supplying operation S160.

In the data accumulating and storing operation S110, data supplied to respective pixels are accumulated and stored. In the degree of degradation determining operation S120, degrees of degradation of the respective pixels are determined based on accumulated data of the pixels. The accumulated data of the respective pixels is image data supplied from an external system or a graphics card and may be grayscale data.

An organic light emitting device may degrade faster for light emitted at a brightness closer to white. Thus, the degree of degradation may become greater as values of accumulated data increase.

In the operation mode determining operation S130, an operation mode, which is the flat up mode or the flat down mode, is selected based on the degrees of degradation of the pixels. In the reference pixel selecting operation S140, a reference pixel according to the operation mode is determined.

If the maximum emission brightness based on the degrees of degradation of the pixels and the maximum emission brightness that may be compensated based on margin ratio significantly differ from the maximum emission brightness of the least degraded pixel, e.g., if it is difficult to perform brightness compensation in the flat up mode, the operation mode is set to the flat down mode in the operation mode determining operation S130. If the difference between the maximum emission brightness that may be compensated and the maximum emission brightness of the least degraded pixel is not significant, the operation mode is set to the flat up mode. The significance may be determined, for example, based on a predetermined value.

In one embodiment, the organic light emitting display device may initially be driven in flat up mode and may be switched to flat down mode from a time point at which the organic light emitting display device may no longer be driven in flat up mode.

In the reference pixel selecting operation S140, the least degraded pixel or the most degraded pixel may be selected as a reference pixel according to the operation mode. For example, in the reference pixel selecting operation S140, if the operation mode is the flat up mode, the least degraded pixel is determined as a reference pixel. If the operation mode is the flat down mode, the most degraded pixel is determined as a reference pixel.

In the modulated data generating operation S150, ratios of the maximum emission brightness of the reference pixel against the maximum emission brightness of the pixels are generated as first coefficients of the pixels, and modulated data to be supplied to the pixels is generated using the first coefficients and margin ratios. In the modulated data supplying operation S160, the modulated data generated in the modulated data generating operation S150 is supplied to the respective pixels.

In the modulated data generating operation S150, ratios of the maximum emission brightness of the reference pixel against the maximum emission brightness of the pixels may be calculated as first coefficients of the pixels, and modulated data to be supplied to the pixels may be generated based on the first coefficients.

Furthermore, in the modulated data generating operation S150, if the operation mode is the flat up mode, first modulated data to be supplied to the pixels is generated to increase brightness of the pixels in proportion to the first coefficients. If the operation mode is the flat down mode, second modulated data to be supplied to the pixels is generated to decrease brightness of the pixels in proportion to the first coefficients.

Figure 9:
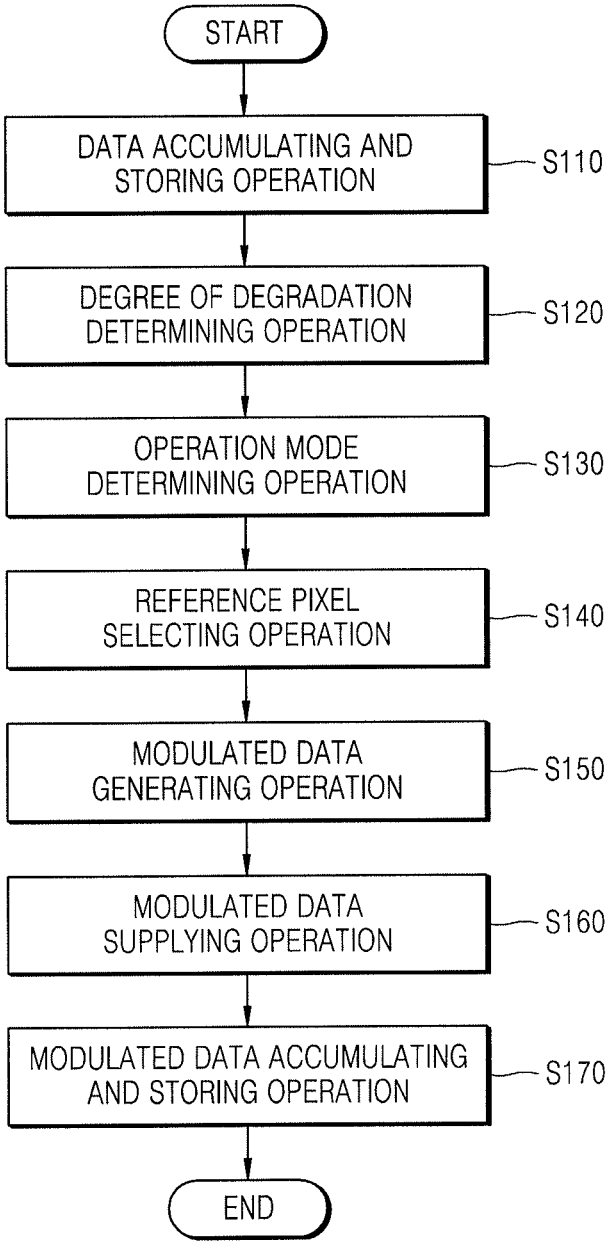
FIG. 9 illustrates another embodiment of a method for driving an organic light emitting display device.

FIG. 9 illustrates another embodiment of a method for driving an organic light emitting display device. Referring to FIG. 9, this method includes a modulated data accumulating and storing operation S170. In the modulated data accumulating and storing operation S170, modulated data generated in the modulated data generating operation S150 of the method described above with reference to FIG. 8 is added to accumulated data of corresponding pixels and stored.

In this embodiment, pixels in the display panel continuously degrade after brightness compensation, and brightness compensation due to degradation may be continuously performed. Therefore, to determine precise degrees of degradation at a time point when a next brightness compensation is performed, all data input to corresponding pixels may be cumulatively stored until the next brightness compensation is performed.

Furthermore, since data supplied to the pixels in the flat up mode or the flat down mode may be the modulated data, the modulated data generated and supplied in the modulated data generating operation S150 may be stored. For example, modulated data supplied for brightness compensation may be stored for determination of precise degrees of degradation, instead of storing input data supplied from an external system or a graphics card. The modulated data accumulating and storing operation 5170 may be performed before the modulated data supplying operation S160.

Figure 10:
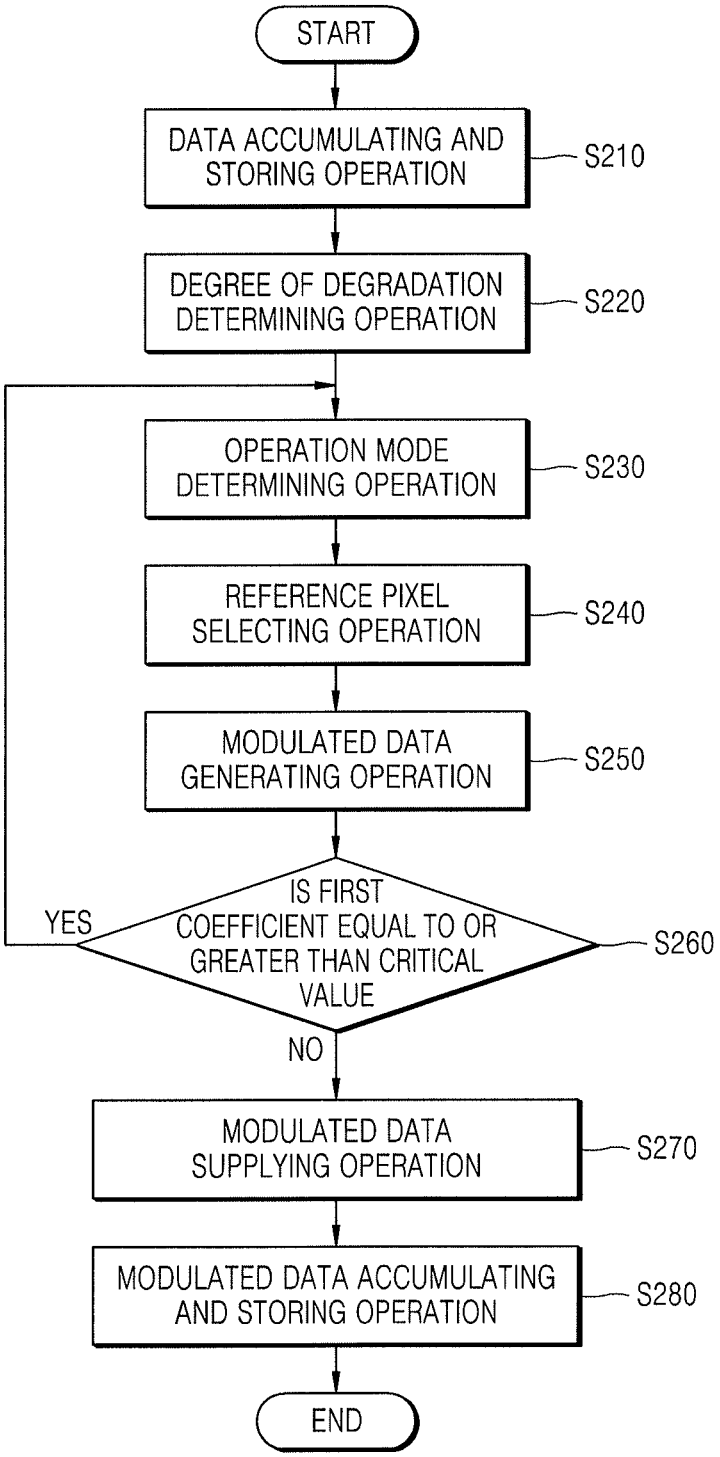
FIG. 10 illustrates another embodiment of a method for driving an organic light emitting display device.

FIG. 10 illustrates another embodiment of a method for driving an organic light emitting display device. The method of FIG. 10 includes a data accumulating and storing operation S210, a degree of degradation determining operation 5220, an operation mode determining operation S230, a reference pixel selecting operation S240, a modulated data generating operation S250, a modulated data supplying operation 5270, and a modulated data accumulating and storing operation S280. The above-stated operations may be substantially identical to respective operations in the methods of FIGS. 8 and 9.

In addition, the method of FIG. 10 includes a determining operation S260 for determining whether a first coefficient is equal to or greater than a critical value. In the determining operation S260, it is determined whether the greatest first coefficient, from among the first coefficients of the respective pixels generated in the modulated data generating operation S250, is equal to or greater than a pre-set critical value.

In the determining operation S260, if it is determined that the first coefficient is equal to or greater than the critical value, the operation mode is changed from the flat up mode to the flat down mode in the operation mode determining operation S230.

The organic light emitting device in each of the pixels may have a certain margin ratio, and the pixels may emit light at brightness greater than a set maximum emission brightness due to the margin ratio. In the flat up mode, brightness compensation of degraded pixels may be performed based on the first coefficient and the margin ratio. However, if it is difficult to perform compensation to increase the brightness of the pixels based on the degrees of degradation of the pixels determined based on the first coefficients and the margin ratio, an organic light emitting display device may no longer be driven in the flat up mode and may be switched to the flat down mode.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

The compensation unit, determining unit, calculating unit, modulating unit, and the other processing features or operations of the embodiments described herein may be implemented in logic which, for example, may include hardware, software, or both. When implemented at least partially in hardware, the compensation unit, determining unit, calculating unit, modulating unit, and the other processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the compensation unit, determining unit, calculating unit, modulating unit, and the other processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

Also, another embodiment may include a computer-readable medium, e.g., a non-transitory computer-readable medium, for storing the code or instructions described above. The computer-readable medium may be a volatile or non-volatile memory or other storage device, which may be removably or fixedly coupled to the computer, processor, controller, or other signal processing device which is to execute the code or instructions for performing the method embodiments described herein.

By way of summation and review, the pixels of an organic light emitting display may not be able to display images of a desired brightness due to degradation of their OLEDs. This degradation may take place over time and may cause the brightness of emitted light to vary among pixels even when a same data signal is applied. In accordance with one or more embodiments, an organic light emitting display device may be controlled to maintain an initial or predetermined brightness even when pixels thereof degrade over time.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the invention as set forth in the following claims.

What is claimed is:

1. An organic light emitting display device, comprising:

a display panel includes a plurality of pixels including an organic light emitting devices to emit light based on data currents corresponding to data voltages;

a storage area to store accumulated data of the pixels;

a degradation compensator to determine degrees of degradation of the pixels based on the accumulated data, select a flat up mode or a flat down mode, select a reference pixel based on the selected mode, generate ratios of a maximum emission brightness of the reference pixel to a maximum emission brightness of the pixels as first coefficients, and generate modulated data for the pixels using the first coefficients and margin ratios; and a panel driver to transform the modulated data to the data voltages, add the modulated data to the accumulated data, and store the accumulated data in the storage area.

2. The device as claimed in claim 1, wherein the degradation compensator includes:

a reference pixel determiner to select a least degraded pixel or a most degraded pixel as the reference pixel based on the selected mode;

a coefficient calculator to calculate ratios of the maximum emission brightness of the reference pixel to the maximum emission brightness of the pixels as first coefficients; and a data modulator to generate the modulated data for the pixels in correspondence to the first coefficients.

3. The device as claimed in claim 2, wherein:

when the selected mode is the flat up mode, the reference pixel determiner is to determine the least degraded pixel as the reference pixel, and the data modulator is to generate first modulated data for the pixels to increase brightness of the pixels in correspondence to the first coefficient.

4. The device as claimed in claim 2, wherein:

when the operation mode is the flat down mode, the reference pixel determiner is to determine the most degraded pixel as the reference pixel, and the data modulator is to generate second modulated data for the pixels to decrease brightness of the pixels in correspondence to the first coefficient.

5. The device as claimed in claim 2, wherein the degradation compensator includes:

an operation mode determiner to change the selected mode from the flat up mode to the flat down mode when a greatest first coefficient of the pixels is equal to or greater than a pre-set critical value.

6. The device as claimed in claim 2, wherein:

when the selected mode is the flat down mode, the coefficient calculator is to calculate second coefficients for uniformly increasing brightness of the pixels, and the data modulator is to generate third modulated data for the pixels based on the first coefficients, the second coefficients, and the second modulated data.

7. The device as claimed in claim 6, wherein the second coefficients are to decrease over time.

8. The device as claimed in claim 1, wherein brightness of the pixels are to increase when the selected mode is the flat up mode.

9. The device as claimed in claim 1, wherein brightness of the pixels are to decrease when the selected mode is the flat down mode.

10. A method for driving an organic light emitting display device, the method comprising:

accumulating data input to a plurality of pixels and storing the accumulated data;

determining degrees of degradation of the pixels based on the accumulated data;

selecting a flat up mode or a flat down mode based on the degrees of degradation of the pixels;

selecting a reference pixel based on the selected mode;

generating ratios of a maximum emission brightness of the reference pixel to a maximum emission brightness of the pixels as first coefficients and generating modulated data to be supplied to the pixels based on the first coefficients and margin ratios; and supplying the modulated data to the pixels.

11. The method as claimed in claim 10, further comprising:

adding the modulated data to the accumulated data of the corresponding pixels and storing the accumulated data.

12. The method as claimed in claim 10, wherein generating the modulated data includes:

calculating ratios of the maximum emission brightness of the reference pixel to the maximum emission brightness of the respective pixels as the first coefficients of the pixels, and generating the modulated data for the pixels in correspondence to the first coefficients.

13. The method as claimed in claim 10, wherein selecting the reference pixel includes selecting a least degraded pixel or a most degraded pixel as the reference pixel based on the selected mode.

14. The method as claimed in claim 13, wherein:

selecting the reference pixel includes selecting the reference pixel as the least decreased pixel when the selected mode is the flat up mode, and generating the modulated data includes generating first modulated data to increase brightness of the pixels in correspondence to the first coefficient.

15. The method as claimed in claim 14, wherein:

selecting the reference pixel includes selecting the most degraded pixel as the reference pixel when the selected mode is the flat down mode, and generating the modulated data includes generating second modulated data for the pixels to decrease brightness of the pixels in correspondence to the first coefficient.

16. The method as claimed in claim 15, further comprising:

generating third modulated data for the pixels based on the first coefficients, the second coefficients, and the second modulated data.

17. The method as claimed in claim 16, wherein the second coefficients decrease over time.

18. The method as claimed in claim 10, further comprising:

changing from the flat up mode to the flat down mode when a greatest first coefficient for the pixels is equal to or greater than a pre-set critical value.

19. An apparatus, comprising:

a degradation compensator to determine degrees of degradation of a plurality of pixels based on data accumulated for the pixels, select a flat up mode or a flat down mode, select a reference pixel based on the selected mode, generate ratios of a predetermined emission brightness of the reference pixel to a predetermined emission brightness of the pixels as first coefficients, and generate modulated data for the pixels using the first coefficients and margin ratios; and a panel driver to transform the modulated data to the data voltages, add the modulated data to the accumulated data, and store the accumulated data in a storage area.

20. The apparatus as claimed in claim 19, wherein the predetermined emission brightness is a maximum emission brightness.

* * * * *